United States Patent [19]

Burks

[11] 4,115,948

[45] Sep. 26, 1978

[54] DRINKING DOLL HAVING WETTING AND NON-WETTING MODES

[76] Inventor: Lucile Burks, 5906 Oxley Dr., Flint, Mich. 48504

[21] Appl. No.: 740,595

[22] Filed: Nov. 10, 1976

[51] Int. Cl.[2] ..... A63H 13/02

[52] U.S. Cl. ..... 46/141

[58] Field of Search ..... 46/141, 135 A

[56] References Cited

U.S. PATENT DOCUMENTS

| | | | |
|---|---|---|---|
| 427,927 | 5/1890 | Steiner | 46/141 |
| 2,080,439 | 5/1937 | Schaeffer | 46/141 |
| 2,196,912 | 4/1940 | Gilbraith | 46/141 |
| 2,945,321 | 7/1960 | Carter | 46/141 X |

FOREIGN PATENT DOCUMENTS

| | | | |
|---|---|---|---|
| 533,053 | 11/1954 | Belgium | 46/135 A |
| 2,204,626 | 8/1973 | Fed. Rep. of Germany | 46/141 |
| 578,606 | 7/1946 | United Kingdom | 46/141 |

*Primary Examiner*—F. Barry Shay

*Attorney, Agent, or Firm*—Basile and Weintraub

[57] ABSTRACT

A wetting doll includes a mouth opening, a second opening, a reservoir, a first conduit leading from mouth to near the reservoir and a second conduit leading from near the first conduit inner end to the second opening. A detachable connector is provided which may be connected to join the two conduits and reservoir in a manner to allow fluid entering the mouth to fill the reservoir but be excluded from the second conduit, or in an alternative manner to allow such fluid to go directly to the second opening but be excluded from the reservoir disposed within the interior thereof for catching the liquid. Upon the reservoir filling up, it is removed from the interior of the doll and emptied.

5 Claims, 4 Drawing Figures

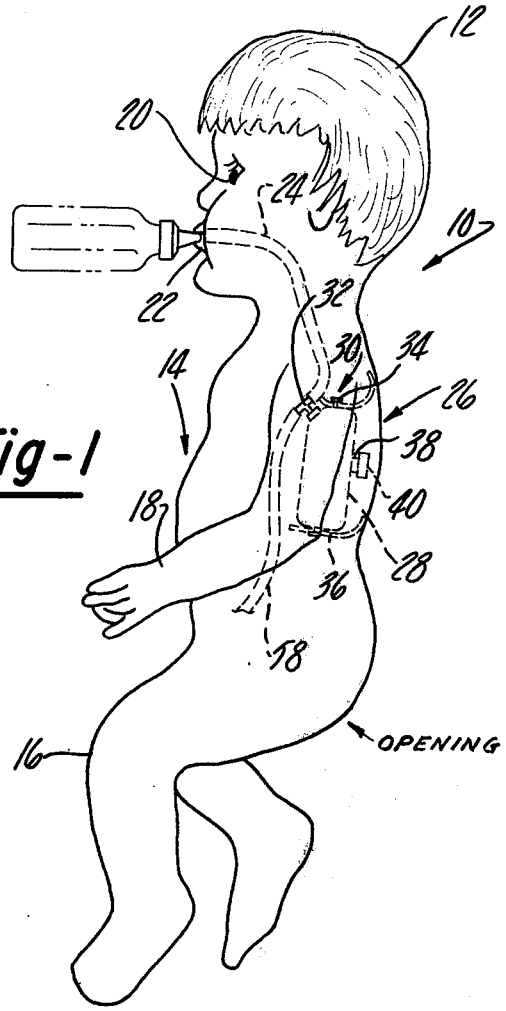
Fig-1
Fig-2
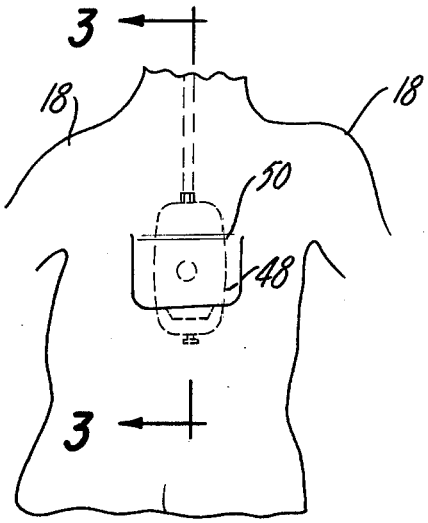
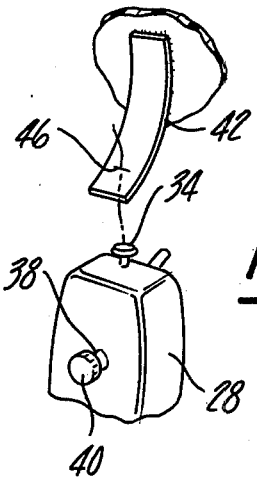
Fig-4
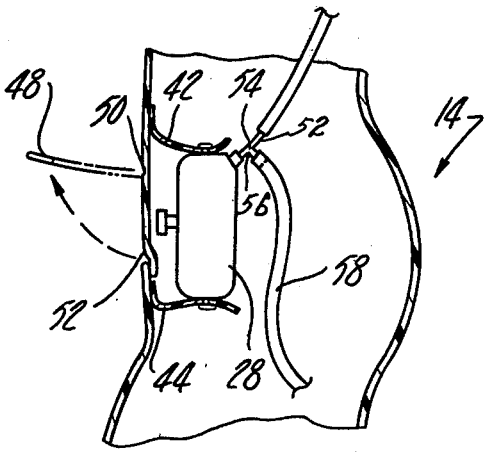
Fig-3

DRINKING DOLL HAVING WETTING AND NON-WETTING MODES

BACKGROUND OF THE INVENTION

1. Field of the Invention

The present invention pertains to toys. More particularly, the present invention pertains to doll-like toys. Even more particularly, the present invention concerns dolls having wetting capabilities.

2. Prior Art

There has been disclosed heretofore in the prior art a plurality of dolls having various human-type functions, such as, for example, a weeping capability, a crying capability and a wetting capability. Such types of dolls have enjoyed increased popularity over the years. The market that has been created has necessitated providing toys, such as dolls, which carry out life-like functions. Thus, the art has taught dolls of the type heretofore defined. See, inter alia, U.S. Pat. Nos. 2,080,439; and 3,839,819.

One of the more disconcerting problems relative to such types of dolls, and in particular, the wetting dolls, is the inability to trap the fluid as it is issued into the interior. of the doll. Although being desirous of necessitating the human function of eliminating the water, this does create a rather messy household situation, especially with younger children. When the fluid is issued from the doll it creates a household inconvenience which is not readily eliminated.

Yet, as the child gets older, it would be most beneficial if one could completely simulate the function of drinking and eliminating fluids. Yet, and as heretofore noted, the prior art has failed to teach a doll of the type under consideration herein which provides the capability of either trapping the fluid or permitting the fluid, once it is "ingested" to be eliminated from an orifice other than the mouth. It is to such a type doll with which the present invention is concerned.

SUMMARY OF THE INVENTION

In accordance herewith, there is provided a doll having an orifice which simulates a mouth. The orifice is in communication with an internally disposed tube. The tube is an elongated conduit which communicates with a reservoir or trap disposed in the interior of the doll.

A second conduit or tube communicates with the reservoir, as well as the first conduit. A T-coupling interconnects the first tubing, the second tubing and the reservoir. Because of the disposition of the T-coupling, and in accordance herewith, fluid entering the interior of the doll through the conduit flows directly into the trap. Only by disconnection of the T-coupling from the conduits and the direct interconnection thereof, or by appropriate overflow control does fluid issue directly into the second conduit. The second conduit terminates at an orifice which simulates a second body opening.

Furthermore, and in accordance with the present invention, the reservoir is removably mounted within the interior of the doll.

The interior of the doll has a mounting member to which the reservoir is mounted. A resilient flap formed on the exterior of the doll is moveable to an open position to permit access to the reservoir to permit the emptying thereof. The trap or reservoir further includes an opening which permits the emptying of the fluid contained therewithin.

For a more complete understanding of the present invention, reference is made to the following detailed description and accompanying drawing. In the drawing like reference characters refer like parts through the several views in which:

BRIEF DESCRIPTION OF THE DRAWING

FIG. 1 is a side elevational view, partly in phantom, of a doll employing the present invention;

FIG. 2 is a rear elevational view of the doll hereof, partly in phantom;

FIG. 3 is a cross-sectional view taken along the line 3—3 of FIG. 2, and FIG. 4 is a broken, perspective, exploded view of the reservoir and its mode of attachment and mounting to the interior of the doll.

DESCRIPTION OF THE PREFERRED EMBODIMENTS

Now, and with reference to the drawing, there is depicted therein a doll, generally, denoted at 10. The doll 10 simulates a human child and includes a head section 12, a torso 14 and a lower leg portion 16. The doll also includes arms 18.

Although not critical to the present invention, it is possible, and in accordance herewith, that the doll incorporate crying mechanisms (not shown), opening and closing eyes 20, as well as other human-like functions which are known to the skilled artisan.

Associated with the head section 12 is an orifice 22 which simulates a mouth. The orifice 22 communicates with and is in registery with a conduit 24, which extends rearwardly from the orifice and into the hollow interior of the doll 10. Preferably, the conduit is formed from a light weight material, such as a synthetic plastic or the like. The only criticality attached to the conduit is that it has sufficient rigidity and structural integrity to carry minor amounts of fluid therewithin.

The lower or free end of the conduit 24 terminates at a reservoir assembly, generally, denoted at 26.

The reservoir assembly is utilized to collect fluid directly from the conduit 24 to prevent spill over of the fluid.

The reservoir assembly 26 comprises a reservoir 28 for collecting fluid, as well as means, generally denoted at 30 for mounting the reservoir within the interior of the doll. The assembly 26 further comprises means for interconnecting the reservoir 28 and the conduit 24, said means for interconnecting being generally depicted at 32.

The reservoir 28 comprises any suitable container which has sufficient structural integrity to retain a fluid therewithin. The reservoir comprises a container having a closed wall construction. The container further comprises a first projection 34 and a lower projection 36. The projections 34 and 36 are diametrically opposed and are integrally formed with the exterior wall of the reservoir. As will be subsequently detailed, the projections comprise a portion of the mounting means 30.

The container further comprises an open neck 38, which is integrally formed with the container and opens into communication therewith. A cap 40 is used to seal the neck by any conventional mode, such as by press fitting, threaded securement or the like.

As will subsequently be detailed, upon removal of the reservoir from the interior of the doll, the cap is opened and the food contained within the reservoir is emptied through the neck.

Referring again to the drawing, and as hereinbefore noted, the reservoir assembly 26 further comprises mounting means 34 removably mounting the reservoir 28 within the interior of the doll 10. As clearly shown in FIGS. 3 and 4, the rear or back of the doll has a pair of spaced apart inwardly directed resilient tabs 42, 44 integrally formed therewith. As noted, each tab is integrally formed with the rear wall of the doll and is integrally directed toward the hollow interior of the doll. Each tab is formed from a semi-rigid material which enables it to be flexed to a certain degree upon the application of sufficient force thereto. Each tab is provided with a transverse slit 46 (only one of which is shown). Since the tabs are formed of a semi-rigid material, each tab can be flexed to open the slit to a greater degree. Thus, upon flexing the tab, the slit may be open to a degree sufficient to receive therewithin the upstanding or cap portion of the projection 34 or 36 associated therewith. In essence, the projections function in much the same manner as buttons which are fitted into button holes, which are comparable to the slits 46. Thus, by mounting the projection to the associated tabs the reservoir is removable mounted within the interior of the doll. It is to be thus appreciated that the tabs with their associated slits cooperate with the projections formed on the reservoir to define the mounting means 30.

In order to provide access to the interior of the doll, the rear or back portion of the doll is provided with a rotatable flap 48 which defines means for access into the interior of the doll. The flap is located proximate the reservoir to facilitate the removal and insertion of the reservoir. The flap comprises an upper edge which is integrally formed with the back portion of the doll. The edge defining a hinge 50 about which rotation occurs. The lower end of the flap snappingly engages the free edge of the back about which the flap is formed, as shown. In essence, the rotatable flap is a cut-out section of the back which can be rotated into and out of a closed position to provide access to the interior. Indentations or the like can be formed in the back, such as at 52 in order to facilitate grasping of the flap for opening same. Thus, in order to obtain access to the reservoir, as well as the interior of the doll, the flap is merely rotated away from the back, thus, enabling access into the interior of the doll. Upon performing the desired function within the interior of the doll, the flap is then rotated back into position to close off the back.

As hereinbefore noted, and as shown in FIGS. 1 and 3, the reservoir assembly further comprises a coupling 32. The coupling, preferably, comprises a T-coupling having a first leg 54 which provides communication between the reservoir 28 and the right angle leg 56 integrally formed with the leg 54 to define the T. The leg 56, which is perpendicular to the leg 54 has a hollow interior, as does the leg 52. The leg 52 is integral with the leg 56 and is in fluid communication therewith. The leg 52 cooperates with the leg 56 to define the cross bar of the T-coupling. The leg 52 has a diameter which can either be slightly greater than or slightly less than the diameter of the conduit 24. In this manner, either the leg or the conduit can be telescoped into the other member to provide a telescoping interengagement and fit therebetween. It should be noted in this regard that the free end of the leg 56 is closed. the reasons for this will become apparent hereinafter.

It is to be appreciated that by closing off the end of the leg 56 of the I-coupling that fluid entering into the conduit 24 can only flow into the reservoir. This, in essence, blocks any flow of fluid past the reservoir and must be collected therewithin. However, and as heretofore noted, the present invention also contemplates the issuance of the fluid from the mouth orifice through a second orifice displaced therefrom to simulate the human like function of eliminating water. To this end, and in accordance with the present invention, there is provided a second conduit 58. The conduit 58 is disposed within the interior of the doll and extends between the first conduit and a second orifice (not shown) formed in the exterior of the doll. The conduit 58 has a diameter substantially equal to that of the first conduit. Thus, the closed end of the leg 56 can be telescoped onto or into the free or interiorly disposed end of the conduit 58. Thus, all conduits within the interior of the doll are securely positioned. It is also to be appreciated with respect hereto that upon removable of the T-coupling from the two conduits, the two free ends of the conduits 24 and 58 can be joined together by any suitable mode thereby providing a continuous passageway from the first orifice or mouth to the second orifice or point of elimination of fluid. Thus, when a child is older the reservoir assembly can be disconnected from the fluid flow path and a doll can be readily provided which enables the flow of fluid to simulate the wetting function. When the child is younger, the child can readily attempt to feed the doll without the situation of fluid over flowing from the doll and creating a domestic problem.

In utilizing the present invention, a childs bottle or the like is placed against the mouth and the fluid therewithin is forced into the first conduit through the orifice 22. Depending on the connection therewithin, fluid either flows therefrom into the reservoir or into the second conduit and out of the second orifice. Upon the reservoir being filled, it is dismounted or dismantled from the mounting means and removed from the interior via the flap. The cap is opened and the fluid is disposed of through the neck. The cap is then replaced and the reservoir is then remounted and the T-coupling is reconnected.

It is to be appreciated from the preceding that there has been disclosed herein a doll which is fully adaptable to simulating the wetting function for an older child while enabling the simulating of a feeding concept without the attendant clean up problems.

Having, thus, described the invention what is claimed is:

1. In a toy doll of the type having a system for simulating the elimination of body fluids, the improvement which comprises:

(a) an opening defining a mouth, (b) a first flow conduit having a first end secured about and in registry with the opening, the first flow conduit extending into the interior of the doll, (c) a reservoir removably mounted within the interior of the doll, (d) means at the exterior surface of the doll for removing the reservoir from the interior of the doll.

(e) a second flow conduit disposed within the doll having a first end in flow communication with a second exterior opening formed in the doll, the second end being proximate the second end of the first flow conduit, and (f) means for detachably interconnecting the reservoir, the second end of the first flow conduit and the second end of the second flow conduit, the interconnecting means being selectively connectable to the reservoir and last mentioned flow conduit ends in a first mode wherein liquid entering the mouth bypasses the second conduit and flows into the reservoir, and in a second mode wherein liquid entering the mouth bypasses the reservoir and flows through the second exterior opening.

2. The improvement of claim 1 wherein the reservoir is removably mounted by means comprising (a) a first tab intergrally formed with the interior wall of the doll and projecting toward the center thereof, (b) a second tab spaced apart from and substantially parallel to the first tab, the second tab being integrally formed with the interior wall of the doll, (c) each tab having a slit formed therein, (d) a pair of projections formed on the reservoir, each projection being associated with one slit and being removably insertable thereinto.

3. The improvement of claim 1 which further comprises:

said means for removing the reservoir including means for access into the interior of the doll, the latter means being formed proximate the reservoir.

4. The improvement of claim 3 wherein the means for access comprises:

a rotatable flap integrally formed with the exterior of the doll.

5. The improvement of claim 2 wherein the means interconnecting the conduits comprises a T-coupling having:

(a) a first conduit communicating with and extending from the reservoir, (b) a second conduit perpendicular to the first conduit and having a first open end and a second closed end, the first end being in telescoping relationship with the second end of the first flow conduit and the second end being in telescoping relationship with the second end of the second flow conduit.

* * * * *

UNITED STATES PATENT AND TRADEMARK OFFICE

CERTIFICATE OF CORRECTION

PATENT NO. : 4,115,948

DATED : September 26, 1978

INVENTOR(S) : Lucile Burks

It is certified that error appears in the above-identified patent and that said Letters Patent are hereby corrected as shown below:

Column 6, line 10, following "claim" delete "2" and insert --1--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*